US012037667B2

(12) United States Patent
Koh et al.

(10) Patent No.: US 12,037,667 B2
(45) Date of Patent: Jul. 16, 2024

(54) HIGH-STRENGTH STEEL HAVING EXCELLENT RESISTANCE TO SULFIDE STRESS CRACKING, AND METHOD FOR MANUFACTURING SAME

(71) Applicant: POSCO, Pohang-si (KR)

(72) Inventors: Seong-Ung Koh, Pohang-si (KR); Yoen-Jung Park, Pohang-si (KR); Hong-Ju Lee, Pohang-si (KR); Hyo-Shin Kim, Pohang-si (KR); Moo-Jong Bae, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 610 days.

(21) Appl. No.: 17/288,807

(22) PCT Filed: Oct. 25, 2019

(86) PCT No.: PCT/KR2019/095038
§ 371 (c)(1),
(2) Date: Apr. 26, 2021

(87) PCT Pub. No.: WO2020/085888
PCT Pub. Date: Apr. 30, 2020

(65) Prior Publication Data

US 2022/0010418 A1 Jan. 13, 2022

(30) Foreign Application Priority Data

Oct. 26, 2018 (KR) ..... 10-2018-0129082
Oct. 26, 2018 (KR) ..... 10-2018-0129083
Oct. 26, 2018 (KR) ..... 10-2018-0129084

(51) Int. Cl.

| | |
|---|---|
| ***C22C 38/50*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |

(52) U.S. Cl.
CPC ..... *C22C 38/50* (2013.01); *C21D 6/004* (2013.01); *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01)

(58) Field of Classification Search
CPC ..... C22C 38/50
See application file for complete search history.

(56) References Cited

U.S. PATENT DOCUMENTS

| | | | | |
|---|---|---|---|---|
| 6,090,226 | A | 7/2000 | Hasegawa et al. | |
| 10,640,841 | B2 | 5/2020 | Kimura et al. | |
| 2010/0206439 | A1* | 8/2010 | Seto | C22C 38/02 148/602 |
| 2012/0018056 | A1 | 1/2012 | Nakagawa et al. | |
| 2013/0092295 | A1 | 4/2013 | Yokoi et al. | |
| 2014/0216609 | A1 | 8/2014 | Nakata et al. | |
| 2018/0355461 | A1 | 12/2018 | Koh et al. | |
| 2020/0095649 | A1 | 3/2020 | Cha et al. | |

FOREIGN PATENT DOCUMENTS

| | | | |
|---|---|---|---|
| CN | 101289727 | A | 10/2008 |
| CN | 102959114 | A | 3/2013 |
| EP | 2623625 | A2 | 8/2013 |
| EP | 3546610 | A1 | 10/2019 |
| EP | 3604584 | A1 | 2/2020 |
| EP | 3604592 | A1 | 2/2020 |
| EP | 3686304 | A1 | 7/2020 |
| JP | H02-250917 | A | 10/1990 |
| JP | H08-199293 | A | 8/1996 |
| JP | 10-298645 | A | 11/1998 |
| JP | H11-80833 | A | 3/1999 |
| JP | 2000-160245 | A | 6/2000 |
| JP | 2003-293083 | A | 10/2003 |
| JP | 2005-298963 | A | 10/2005 |
| JP | 2008-056962 | A | 3/2008 |
| JP | 2009-052137 | A | 3/2009 |
| JP | 2009-174020 | A | 8/2009 |
| JP | 2013-139628 | A | 7/2013 |
| JP | 2015-199987 | A | 11/2015 |
| JP | 2016-108648 | A | 6/2016 |
| JP | 6123973 | B2 | 4/2017 |
| JP | 6288390 | B1 | 2/2018 |

(Continued)

OTHER PUBLICATIONS

International Search Report and Written Opinion issued in corresponding International Application No. PCT/KR2019/095038.
Japanese Office Action dated Jul. 19, 2022 issued in Japanese Patent Application No. 2021-522516.
Extended European Search Report dated Nov. 11, 2021 issued in European Patent Application No. 19875085.3.
Chinese Office Action dated Dec. 1, 2021 issued in Chinese Patent Application No. 201980069981.6 (with English translation).

*Primary Examiner* — Christopher S Kessler
(74) *Attorney, Agent, or Firm* — Morgan, Lewis & Bockius LLP

(57) ABSTRACT

The present invention relates to a thick steel suitable for use as a line pipe, a sour-resistant material, or the like and, more specifically, to a high-strength steel having excellent resistance to sulfide stress cracking, and a method for manufacturing same.

3 Claims, 3 Drawing Sheets

(56) References Cited

FOREIGN PATENT DOCUMENTS

| | | | |
|---|---|---|---|
| JP | 6369658 | B1 | 7/2018 |
| KR | 10-0165151 | B1 | 4/1996 |
| KR | 10-2004-0021117 | A | 3/2004 |
| KR | 10-2008-0036475 | A | 4/2008 |
| KR | 10-0833070 | B1 | 5/2008 |
| KR | 10-2011-0102216 | A | 9/2011 |
| KR | 10-2011-0110278 | A | 10/2011 |
| KR | 10-2016-0077392 | A | 7/2016 |
| KR | 10-2016-0099113 | A | 8/2016 |
| KR | 10-2017-0074319 | A | 6/2017 |
| KR | 10-1819356 | B1 | 1/2018 |
| KR | 10-2018-0074281 | A | 7/2018 |
| WO | 2018/179169 | A1 | 10/2018 |
| WO | 2018/179512 | A1 | 10/2018 |
| WO | 2018/181564 | A1 | 10/2018 |

* cited by examiner

[FIG. 1]
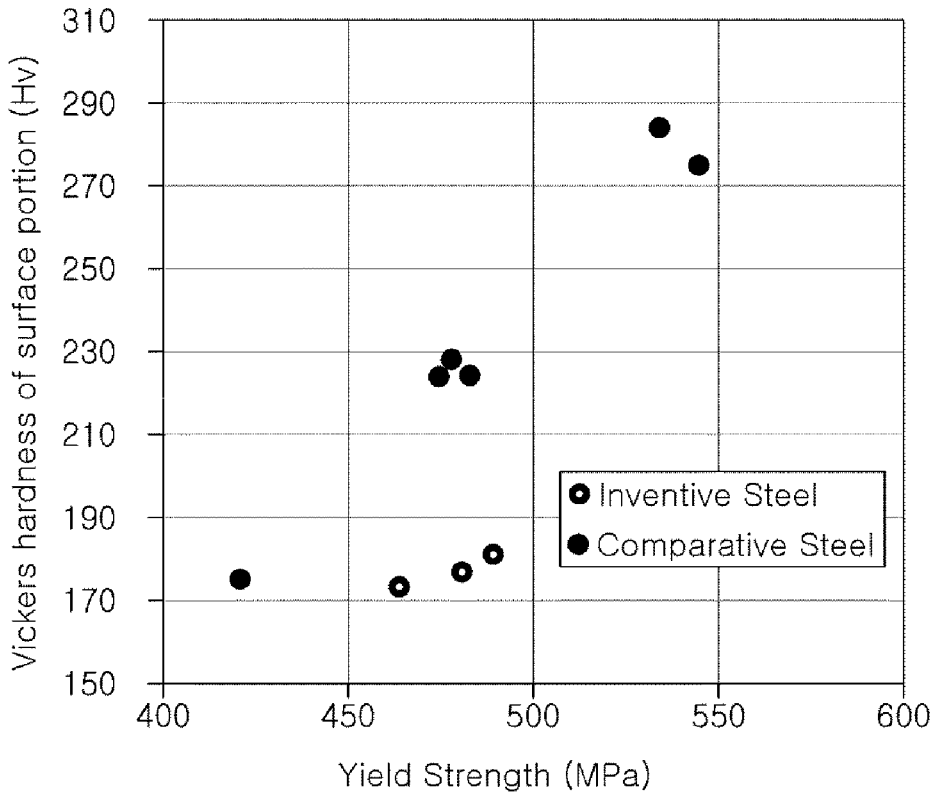

[FIG. 2]
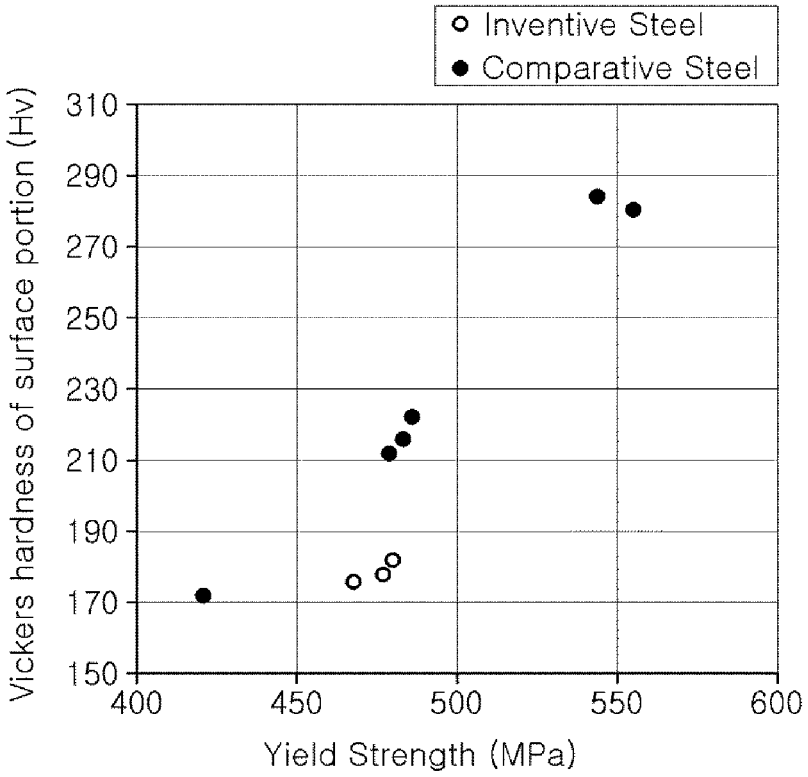

[FIG. 3]
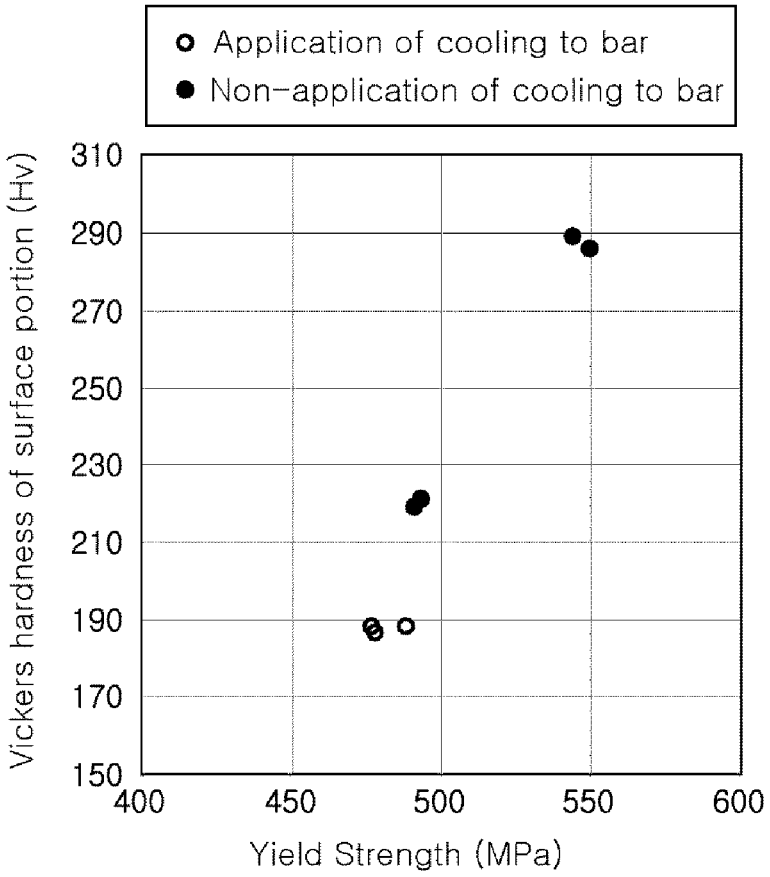

HIGH-STRENGTH STEEL HAVING EXCELLENT RESISTANCE TO SULFIDE STRESS CRACKING, AND METHOD FOR MANUFACTURING SAME

CROSS REFERENCE

This application is the U.S. National Phase under 35 U.S.C. § 371 of International Application No. PCT/KR2019/095038 filed on Oct. 25, 2019, which claims the benefit of Korean Application Nos. 10-2018-0129082 filed on Oct. 26, 2018, 10-2018-0129083 filed on Oct. 26, 2018 and 10-2018-0129084 filed on Oct. 26, 2018, the entire contents of each are hereby incorporated by reference.

TECHNICAL FIELD

The present disclosure relates to a thick steel material suitable for use such as a line pipe, a sour gas resistant material and the like, and more particularly, to a high strength steel having excellent resistance to sulfide stress cracking, and a method of manufacturing the same.

BACKGROUND ART

Recently, there is an increasing demand for an upper limit on the surface hardness of line pipe steel. When the surface hardness of line pipe steel is high, it causes not only problems such as uneven out of roundness during pipe processing, but also cracks occurring during pipe processing due to the high hardness structure of the pipe surface or insufficient toughness in the use environment. In addition, when the high-hardness structure of the surface portion is used in a sour gas environment with a large amount of hydrogen sulfide, it is highly likely to cause a brittle cracking due to hydrogen and cause a large-scale accident.

In 2013, there was the case, in which during a large crude oil/natural gas mining project in the Caspian Sea, sulfide stress cracking (SSC) occurred in the high hardness part of the pipe surface within two weeks of operation, and thus, a 200 km submarine pipeline was replaced with a clad pipe. At this time, as a result of analyzing the cause of the occurrence of SSC, it is estimated that the formation of a hard spot, which is a high hardness structure on the surface of the pipe, was the cause.

The API standard stipulates a hard spot with a length of 2 inches or more and an Hv of 345 or more. In the DNV standard, the size standard is the same as the API standard, but the upper limit of the hardness is stipulated as HV 250.

On the other hand, steel for line pipes is generally manufactured by reheating steel slabs, performing hot rolling and performing accelerated cooling thereon, and it is determined that a hard spot (a portion of formation of a high-hardness structure) occurs as the surface portion is rapidly cooled unevenly during accelerated cooling.

In a steel sheet manufactured by conventional water cooling, since water is sprayed on the surface of the steel sheet, the cooling rate of the surface portion is faster than that of the central portion, and due to the difference in cooling rates, the hardness of the surface portion becomes higher than that of the central portion.

Accordingly, as a method for suppressing the formation of a high-hardness structure on the surface portion of the steel, a method of relieving the water cooling process may be considered, but the reduction of the surface hardness due to the relaxation of the water cooling simultaneously causes a decrease in the strength of the steel, causing problems such as having to add more alloying elements. In addition, such an increase in the alloying elements may cause an increase in surface hardness.

DISCLOSURE

Technical Problem

An aspect of the present disclosure is to provide a high-strength steel material having excellent resistance to sulfide stress cracking, and a method of manufacturing the same, in which hardness of a surface portion is effectively reduced, compared to a thick plate water-cooled (Thermo-Mechanical Control Process, TMCP) steel material of the related art, by optimization of alloy composition and manufacturing conditions.

The subject of the present disclosure is not limited to the above description. Anyone of ordinary skill in the art to which the present disclosure pertains will not have difficulty in understanding the additional subject of the present disclosure from the contents throughout the present specification.

Technical Solution

According to an aspect of the present disclosure, a high-strength steel material having excellent resistance to sulfide stress cracking, comprises: in % by weight, carbon (C): 0.02 to 0.06%, silicon (Si): 0.1 to 0.5%, manganese (Mn): 0.8 to 1.8%, phosphorus (P): 0.03% or less, sulfur (S): 0.003% or less, aluminum (Al): 0.06% or less, nitrogen (N): 0.01% or less, niobium (Nb): 0.005 to 0.08%, titanium (Ti): 0.005 to 0.05%, and calcium (Ca): 0.0005 to 0.005%; at least one of nickel (Ni): 0.05 to 0.3%, chromium (Cr): 0.05 to 0.3%, molybdenum (Mo): 0.02 to 0.2% and vanadium (V): 0.005 to 0.1%; and Fe and unavoidable impurities as balances, wherein the Ca and S satisfy relational formula 1: $0.5 \leq Ca/S \leq 5.0$, where each element refers to weight content, and a difference between a hardness of a surface layer portion and a hardness of a central portion (surface portion hardness-center portion hardness) is 20 Hv or less of Vickers hardness.

According to another aspect of the present disclosure, a method of manufacturing a high-strength steel material having excellent resistance to sulfide stress cracking, includes: heating a steel slab satisfying the above-described alloy composition and relational formula 1 at a temperature ranging from 1100 to 1300° C.; manufacturing a hot-rolled plate by finish hot rolling the heated steel slab; and cooling after the finish hot rolling, wherein the cooling includes primary cooling, air cooling, and secondary cooling, and the primary cooling is performed at a cooling rate of 5 to 40° C./s so that a surface temperature of the hot-rolled plate is Ar1−50° C. to Ar3−50° C., and the secondary cooling is performed at a cooling rate of 50 to 500° C./s so that the surface temperature of the hot rolled plate is 300 to 600° C.

According to another aspect of the present disclosure, a method of manufacturing a high-strength steel material having excellent resistance to sulfide stress cracking, includes: heating a steel slab satisfying the above-described alloy composition and relational formula 1 at a temperature ranging from 1100 to 1300° C.; manufacturing a hot-rolled plate by finish hot rolling the heated steel slab; and cooling after the finish hot rolling, wherein the cooling includes primary cooling and secondary cooling, and the primary cooling is performed at a cooling rate of 5 to 40° C./s so that a surface temperature of the hot-rolled plate is Ar1−150° C. to Ar1−50° C., and the secondary cooling is performed at a cooling rate of 50 to 500° C./s so that the surface temperature of the hot rolled plate is 300 to 600° C.

According to another aspect of the present disclosure, a method of manufacturing a high-strength steel material having excellent resistance to sulfide stress cracking, includes: heating a steel slab satisfying the above-described alloy composition and relational formula 1 at a temperature ranging from 1100 to 1300° C.; rough rolling the heated steel slab to produce a bar; cooling and recalescence the bar obtained by the rough rolling; manufacturing a hot-rolled plate by finish hot-rolling the cooled and recalesced bar; and cooling after the finish hot rolling, wherein the cooling of the bar is performed by Ar3 or less, and the recalescence is performed so that a temperature of the bar is within an austenite single-phase region.

Advantageous Effects

According to an exemplary embodiment of the present disclosure, in providing thick steel material having a predetermined thickness, a high-strength steel having excellent resistance to sulfide stress cracking by effectively reducing the hardness of a surface portion may be provided.

The steel according to an exemplary embodiment of the present disclosure may be advantageously applied not only as a pipe material such as a line pipe or the like, but also as a sour gas resistant material.

DESCRIPTION OF DRAWINGS

FIGS. 1 to 3 are graphs illustrating the relationship between yield strength and surface portion hardness of an inventive steel and a comparative steel, according to an embodiment of the present disclosure.

BEST MODE FOR INVENTION

Currently, in the case of thick plate material and Thermo-Mechanical Control Process (TMCP) materials supplied to the hot-rolled market and the like, the hardness of the surface portion is higher than that of the central portion due to an inevitable phenomenon during cooling after hot rolling (a phenomenon in which the cooling rate of the surface portion is faster than that of the central portion). For this reason, as the strength of the material increases, the hardness on the surface portion increases significantly, compared to the central portion, and such an increase in the hardness of the surface portion causes cracks during processing or impairs low-temperature toughness, and furthermore, in the case of steel materials applied to the sour gas environment, there is a problem of reaching an initiation point of hydrogen embrittlement.

Accordingly, the inventors of the present disclosure have studied in depth a method capable of solving the above problems. In detail, it is intended to provide a steel material having high strength as well as resistance to sulfide stress cracking by effectively lowering the hardness of the surface portion of a thick steel material having a predetermined thickness or more.

As a result, in manufacturing the thick steel material, it was confirmed that the intended steel material may be provided by deriving a method that may separate and control the phase transformations of the surface portion and the central portion, to be applied with optimization thereof, by which the present invention could be completed.

Hereinafter, exemplary embodiments of the present disclosure will be described in detail.

A high-strength steel material having excellent resistance to sulfide stress cracking according to an exemplary embodiment of the present disclosure may include, in % by weight, carbon (C): 0.02 to 0.06%, silicon (Si): 0.1 to 0.5%, manganese (Mn): 0.8 to 1.8%, phosphorus (P): 0.03% or less, sulfur (S): 0.003% or less, aluminum (Al): 0.06% or less, nitrogen (N): 0.01% or less, niobium (Nb): 0.005 to 0.08%, titanium (Ti): 0.005 to 0.05%, calcium (Ca): 0.0005 to 0.005%, and at least one of nickel (Ni): 0.05 to 0.3%, chromium (Cr): 0.05 to 0.3%, molybdenum (Mo): 0.02 to 0.2% and vanadium (V): 0.005 to 0.1%.

Hereinafter, the reason for limiting the alloy composition of the steel material provided by an exemplary embodiment of the present disclosure as described above will be described in detail.

On the other hand, unless otherwise specified in the present disclosure, the content of each element is based on the weight, and the ratio of the structure is based on the area.

Carbon (C): 0.02~0.06%

Carbon (C) is an element that has a greatest influence on the properties of steel. If the content of C is less than 0.02%, there is a problem in that the component control cost is excessively generated in the steelmaking process, and the welding heat-affected zone is softened further than necessary. On the other hand, if the content exceeds 0.06%, resistance to hydrogen-induced cracking of the steel sheet may be reduced and weldability may be impaired.

Therefore, in the present disclosure, C may be included in an amount of 0.02 to 0.06%, and in more detail, may be included in an amount of 0.03 to 0.05%.

Silicon (Si): 0.1~0.5%

Silicon (Si) is not only used as a deoxidizing agent in the steelmaking process, but is an element increasing the strength of steel. If the Si content exceeds 0.5%, the low-temperature toughness of the material is deteriorated, weldability is impaired, and scale peelability during rolling is deteriorated. On the other hand, in order to lower the Si content to be less than 0.1%, the manufacturing cost increases. Thus, in an exemplary embodiment of the present disclosure, the Si content may be limited to be 0.1 to 0.5%.

Manganese (Mn): 0.8~1.8%

Manganese (Mn) is an element improving the hardenability of steel without impairing low-temperature toughness, and may be included in an amount of 0.8% or more. However, if the content exceeds 1.8%, central segregation occurs, and thus, there is a problem in which the hardenability of the steel increases and the weldability is deteriorated, as well as deteriorating the low-temperature toughness. In addition, central segregation of Mn is a factor causing hydrogen-induced cracking.

Therefore, in the present disclosure, the Mn may be included in an amount of 0.8 to 1.8%, and in more detail, may be included in an amount of 1.0 to 1.4%.

Phosphorus (P): 0.03% or Less

Phosphorus (P) is an element that is unavoidably added in steel, and if a content thereof exceeds 0.03%, not only the weldability is significantly lowered, but also the low-temperature toughness decreases. Therefore, it is necessary to limit the P content to be 0.03% or less, and it may be more preferable to limit the P content to be 0.01% or less in terms of securing low-temperature toughness. However, 0% may be excluded in consideration of the load during the steelmaking process.

Sulfur (S): 0.003% or Less

Sulfur (S) is an element that is unavoidably added in steel, and if a content thereof exceeds 0.003%, there is a problem of reducing the ductility, low temperature toughness, and weldability of the steel. Therefore, it is necessary to limit the content of S to 0.003% or less. On the other hand, the S is combined with Mn in the steel to form MnS inclusions, and in this case, the hydrogen-induced cracking resistance of the steel is lowered. Therefore, it may be more preferable to limit the S content to 0.002% or less. However, 0% may be excluded in consideration of the load during the steelmaking process.

Aluminum (Al): 0.06% or Less (Excluding 0%)

Aluminum (Al) generally acts as a deoxidizer to remove oxygen by reacting with oxygen (O) present in the molten steel. Therefore, the Al may be added to the extent that it may have a sufficient deoxidizing power in the steel. However, if the content exceeds 0.06%, a large amount of oxide-based inclusions are formed, to impair the low-temperature toughness of the material and the resistance to hydrogen-induced cracking, which is not preferable.

Nitrogen (N): 0.01% or Less

Since nitrogen (N) is difficult to completely remove industrially from steel, the upper limit thereof is 0.01%, which is an allowable range in the manufacturing process. On the other hand, the N reacts with Al, Ti, Nb, V, or the like in the steel to form nitride, thereby inhibiting the growth of austenite grains, and therefore, the N has an advantageous effect on improving the toughness and strength of the material, but if a content thereof is added excessively to exceed 0.01%, N in a solid solution state is present, which adversely affects the low-temperature toughness. Accordingly, the content of N may be limited to 0.01% or less, and 0% may be excluded in consideration of the load during the steelmaking process.

Niobium (Nb): 0.005~0.08%

Niobium (Nb) is an element effective in dissolving when the slab is heated, suppressing the growth of austenite grains during subsequent hot rolling, and being precipitated thereafter, to improve the strength of the steel. In addition, Nb is combined with C in the steel and is precipitated as carbide, thereby significantly reducing the increase in yield ratio and improving the strength of the steel.

If the content of Nb is less than 0.005%, the above-described effect may not be sufficiently obtained. On the other hand, if the content exceeds 0.08%, austenite grains are not only fined more than necessary, but low-temperature toughness and resistance to hydrogen-induced cracking are deteriorated due to the formation of coarse precipitates.

Therefore, in the present disclosure, the Nb may be included in an amount of 0.005 to 0.08%, and in more detail, may be included in an amount of 0.02 to 0.05%.

Titanium (Ti): 0.005~0.05%

Titanium (Ti) is effective in inhibiting the growth of austenite grains by bonding with N and precipitation in the form of TiN when the slab is heated.

If Ti is added in an amount of less than 0.005%, the austenite grains become coarse, reducing the low-temperature toughness. On the other hand, if the content exceeds 0.05%, coarse Ti-based precipitates are also formed, resulting in reducing low-temperature toughness and resistance to hydrogen-induced cracking.

Accordingly, in the present disclosure, the Ti may be included in an amount of 0.005 to 0.05%, and in terms of securing low-temperature toughness, may be more preferably included in an amount of 0.03% or less.

Calcium (Ca): 0.0005~0.005%

Calcium (Ca) serves to suppress the segregation of MnS causing hydrogen-induced cracking by forming CaS by bonding with S during the steelmaking process. In order to sufficiently obtain the above-described effect, it is necessary to add the Ca in an amount of 0.0005% or more, but if the content exceeds 0.005%, not only CaS is formed, but also CaO inclusions are formed, causing hydrogen-induced cracking due to the inclusions.

Therefore, in the present disclosure, the Ca may be included in an amount of 0.0005 to 0.005%, and may be more preferably included in an amount of 0.001 to 0.003% in terms of securing resistance to hydrogen-induced cracking.

As described above, in containing Ca and S, it may be preferable that the component ratio (Ca/S) of Ca and S satisfies the following relational formula 1.

The component ratio of Ca and S is an index representing the central segregation of MnS and the formation of coarse inclusions. If the value of the component ratio thereof is less than 0.5, MnS is formed in the central portion of the steel thickness to reduce the resistance to hydrogen-induced cracking, whereas the value exceeds 5.0, Ca-based coarse inclusions are formed to lower the hydrogen-induced cracking resistance. Therefore, it may be preferable that the component ratio (Ca/S) of Ca and S satisfies the following relational formula 1.

$0.5 \leq Ca/S \leq 5.0$ (where each element refers to weight content) [Relational Formula 1]

On the other hand, the high-strength steel material according to an exemplary embodiment of the present disclosure may further include elements that may further improve physical properties in addition to the above-described alloy composition, and in detail, may further include at least one of nickel (Ni): 0.05 to 0.3%, chromium (Cr): 0.05 to 0.3%, molybdenum (Mo): 0.02 to 0.2% and vanadium (V): 0.005 to 0.1%.

Nickel (Ni): 0.05~0.3%

Nickel (Ni) is an element effective in improving the strength without deteriorating the low-temperature toughness of steel. In order to obtain such an effect, Ni may be added in an amount of 0.05% or more, but the Ni is an expensive element, and if the content exceeds 0.3%, there is a problem that the manufacturing cost is greatly increased.

Therefore, in the present disclosure, when the Ni is added, the Ni content may be 0.05 to 0.3%.

Chrome (Cr): 0.05~0.3%

Chromium (Cr) is dissolved in austenite when heating the slab and serves to improve the hardenability of steel material. In order to obtain the above-described effect, Cr may be added in an amount of 0.05% or more, but if the content exceeds 0.3%, there is a problem that the weldability is deteriorated.

Therefore, in the present disclosure, when the Cr is added, the content may be 0.05 to 0.3%.

Molybdenum (Mo): 0.02~0.2%

Molybdenum (Mo) serves to improve the hardenability of steel material similarly to the Cr and to increase the strength. To obtain the above-described effect, Mo may be added in an amount of 0.02% or more, but if the content exceeds 0.2%, there is a problem in which a structure vulnerable to low-temperature toughness such as upper bainite is formed, and hydrogen-induced cracking resistance is inhibited.

Therefore, in the present disclosure, when the Mo is added, the content may be 0.02 to 0.2%.

Vanadium (V): 0.005~0.1%

Vanadium (V) is an element improving the strength by increasing the hardenability of the steel material, and for this effect, V needs to be added in an amount of 0.005% or more. However, if the content exceeds 0.1%, the hardenability of the steel increases excessively, forming a structure vulnerable to low-temperature toughness, and the resistance to hydrogen-induced cracking is reduced.

Therefore, in the present disclosure, when the V is added, the content may be 0.005 to 0.1%.

The remaining component in the exemplary embodiment of the present disclosure is iron (Fe). However, since unintended impurities from the raw material or the surrounding environment may inevitably be mixed in the normal manufacturing process, this cannot be excluded. Since these impurities are known to anyone of ordinary skill in the manufacturing process, all the contents are not specifically mentioned in the present specification.

In the high-strength steel material according to an exemplary embodiment of the present disclosure having the above-described alloy composition, the difference between the hardness of a surface layer portion and the hardness of a central portion (surface layer hardness−center portion hardness) may be controlled to be less than or equal to 20 Hv of Vickers hardness. In this case, a case in which the hardness value of the surface layer portion is lower than the hardness value of the central portion may be included.

That is, in the steel material according to an exemplary embodiment of the present disclosure, the difference in hardness between the surface layer portion and the central portion may be significantly reduced while securing the strength equal to or higher than that of the related art TMCP steel material. Therefore, the formation and propagation of cracks during processing may be suppressed, and thus resistance to hydrogen-induced cracking and resistance to sulfide stress corrosion cracking may be relatively excellent. In detail, the steel material according to an exemplary embodiment of the present disclosure may have a yield strength of 450 MPa or more.

In this case, the surface layer portion refers to from the surface to a point of 0.5 mm in the thickness direction, which may correspond to both sides of the steel material. In addition, the central portion refers to the remaining area except for the surface layer portion.

In the present disclosure, the hardness of the surface layer portion represents a maximum hardness value measured with a 1 kgf load, from the surface to a point of 0.5 mm in the thickness direction, using a Vickers hardness tester, and the average hardness of the central portion represents the average value of the hardness values measured at the point t/2. Usually, hardness may be measured about 5 times for each location.

In the present disclosure, the microstructure of the steel material is not specifically limited, and any phase and any fraction range may be used as long as the structure configuration is provided in which the hardness difference between the surface layer portion and the central portion is 20 Hv or less.

In detail, the microstructure of the surface layer portion of the steel material may have the same or softer phase as the microstructure of the central portion. For example, when the microstructure of the surface layer portion of the steel material is composed of a complex structure of ferrite and pearlite, the central portion microstructure may be composed of acicular ferrite, but the configuration is not limited thereto.

Hereinafter, a method of manufacturing a high-strength steel material according to an exemplary embodiment of the present disclosure, in which the difference in hardness between the surface layer portion and the central portion is significantly reduced as described above, will be described in detail.

The high-strength steel material according to an exemplary embodiment of the present disclosure may be manufactured by various methods, and examples thereof will be described in detail below.

As an example, the high-strength steel material may be manufactured through the process of [slab heating-rolling-cooling (primary cooling, air cooling and secondary cooling)].

Slab Heating

After preparing a steel slab that satisfies the alloy composition and component relationship proposed in the present disclosure, the steel slab may be heated, and in this case, the heating may be carried out at a temperature ranging from 1100 to 1300° C.

If the heating temperature exceeds 1300° C., not only the scale defects increase, but also the austenite grains become coarse, and thus, there is a concern that the hardenability of steel may increase. In addition, there is a problem in that resistance to hydrogen-induced cracking is deteriorated by increasing the fraction of structure vulnerable to low-temperature toughness, such as upper bainite, in the central portion. On the other hand, if the temperature is less than 1100° C., there is a concern that the re-solid solution rate of the alloying element is lowered.

Therefore, in the present disclosure, the steel slab may be heated at a temperature ranging from 1100 to 1300° C., and in terms of securing strength and resistance to hydrogen-induced cracking, may be heated at a temperature ranging from 1150 to 1250° C.

Hot Rolling

The heated steel slab may be hot-rolled to produce a hot-rolled plate, and at this time, finish hot rolling may be performed at a cumulative reduction ratio of 50% or more in a temperature range of Ar3+50° C. to Ar3+250° C.

If the temperature during the finish hot rolling is higher than Ar3+250° C., there is a problem in that a structure vulnerable to low temperature toughness, such as upper bainite, is formed due to an increase in hardenability due to grain growth, and thus hydrogen-induced cracking characteristics are deteriorated. On the other hand, if the temperature is lower than Ar3+50° C., the temperature at which the subsequent cooling is started becomes too low, and thus, there is a concern that the fraction of air-cooled ferrite becomes excessive and the strength may decrease.

If the cumulative reduction ratio during finish hot rolling in the above-described temperature range is less than 50%, recrystallization by rolling does not occur to the center portion of the steel material, resulting in coarsening of crystal grains at the center portion and deterioration of low temperature toughness.

Cooling

The hot-rolled plate manufactured according to the above may be cooled, and in detail, in the present disclosure, there will be technical significance in proposing an optimal cooling process capable of obtaining a steel material in which a difference in hardness between the surface layer portion and the central portion is significantly reduced.

In detail, the cooling may include primary cooling; air cooling; and secondary cooling, and respective process conditions will be described in detail below. In this case, the primary cooling and secondary cooling may be performed by applying a specific cooling means, and water cooling may be applied as an example.

Primary Cooling

In the present disclosure, primary cooling may be performed immediately after terminating the above-described finish hot rolling, and in detail, may be preferable to start when the surface temperature of the hot-rolled plate obtained by the finish hot rolling is Ar3−20° C. to Ar3+50° C.

If the starting temperature of the primary cooling exceeds Ar3+50° C., the phase transformation to ferrite on the surface portion may not be sufficiently performed during the primary cooling, and thus, the effect of reducing the hardness of the surface portion cannot be obtained. On the other hand, if the temperature is less than Ar3−20° C., excessive ferrite transformation occurs to the center portion, which causes the strength of the steel to decrease.

In addition, the primary cooling may be preferably performed at a cooling rate of 5 to 40° C./s such that the surface temperature of the hot-rolled plate is Ar1−50° C. to Ar3−50° C.

For example, if the end temperature of the primary cooling exceeds Ar3−50° C., the fraction of the phase transformation into ferrite in the surface portion of the primary cooled hot-rolled plate is relatively low, and thus, the effect of reducing the hardness of the surface portion may not be effectively obtained. On the other hand, if the temperature is lower than Ar1−50° C., ferrite phase transformation occurs excessively to the center portion, and thus, it may be difficult to secure the target level of strength.

In addition, if the cooling rate in the primary cooling is too slow, such as less than 5° C./s, it is difficult to secure the above-described primary cooling end temperature. On the other hand, if it exceeds 40° C./s, since the fraction of transformation into a harder phase such as an acicular ferrite phase than that of ferrite, on the surface portion increases, it is difficult to secure a soft phase on the surface portion, compared to the central portion.

After completion of the primary cooling, it may be preferable that the temperature of the center portion of the hot-rolled plate is controlled to be Ar3−30° C. to Ar3+30° C.

If the temperature of the central portion exceeds Ar3+30° C. after completion of the primary cooling, the temperature of the surface portion cooled to a specific temperature range increases, and the ferrite phase transformation fraction of the surface portion decreases. On the other hand, if the temperature of the central portion is less than Ar3−30° C., the central portion is excessively cooled and the temperature at which the surface portion may be recalesced during subsequent air cooling is lowered such that a tempering effect cannot be obtained, which reduces the effect of reducing the hardness of the surface portion.

Air Cooling

It may be preferable to air-cool the hot-rolled plate in which primary cooling has been completed under the above-described conditions, and an effect that the surface portion is recalesced by the central portion having a relatively high temperature may be obtained through the air-cooling process.

The air cooling may be preferably terminated when the temperature of the surface portion of the hot-rolled plate is within a temperature range of Ar3−10° C. to Ar3−50° C.

If the temperature of the surface portion is lower than Ar3−50° C. after the air cooling is completed, the time for forming the air-cooled ferrite is insufficient, and furthermore, the tempering effect by recalescence the surface portion is insufficient, which is disadvantageous in reducing the hardness of the surface portion. On the other hand, if the temperature exceeds Ar3−10° C., the air cooling time is excessive and thus the ferrite phase transformation occurs in the center portion, such that it is difficult to secure the target level of strength.

Secondary Cooling

It may be preferable to perform secondary cooling immediately after the air cooling is completed in the above-described temperature range (based on the temperature of the surface portion), and the secondary cooling may be preferably performed at a cooling rate of 50 to 500° C./s such that the temperature of the surface portion is 300 to 600° C.

For example, if the end temperature of the secondary cooling is less than 300° C., the fraction of the MA phase increases in the central portion, which adversely affects the securing of low temperature toughness and suppression of hydrogen embrittlement. On the other hand, if the temperature exceeds 600° C., the phase transformation in the central portion is not complete and thus, it is difficult to secure strength.

In addition, if the cooling rate is less than 50° C./s during the secondary cooling in the above-described temperature range, crystal grains in the central portion become coarse, and thus, it may be difficult to secure the target level of strength. On the other hand, if the cooling rate exceeds 500° C./s, the fraction of the phase that is vulnerable to low-temperature toughness, as a microstructure of the central portion, such as upper bainite, increases, which deteriorates the resistance to hydrogen-induced cracking.

As another example, the steel material according to an exemplary embodiment of the present disclosure may be manufactured through the process of [slab heating-rolling-cooling (primary cooling and secondary cooling)].

Slab Heating

After preparing a steel slab that satisfies the alloy composition and component relationship proposed in the present disclosure, the steel slab may be heated, and at this time, the heating may be carried out at 1100 to 1300° C.

If the heating temperature exceeds 1300° C., not only the scale defects increase, but also the austenite grains become coarse, and thus, there may be a concern that the hardenability of the steel may increase. In addition, there is a problem in that resistance to hydrogen-induced cracking is deteriorated by increasing the fraction of the structure vulnerable to low-temperature toughness, such as upper bainite, in the central portion. On the other hand, if the temperature is less than 1100° C., there is a concern that the re-solid solution rate of the alloying element is lowered.

Therefore, in the present disclosure, the steel slab may be heated at a temperature ranging from 1100 to 1300° C., and in terms of securing strength and resistance to hydrogen-induced cracking, may be performed in a temperature range of 1150 to 1250° C.

Hot Rolling

The heated steel slab may be hot-rolled to produce a hot-rolled plate, and at this time, finish hot rolling may be performed at a cumulative reduction ratio of 50% or more in a temperature range of Ar3+50° C. to Ar3+250° C.

If the temperature during the finish hot rolling is higher than Ar3+250° C., there is a problem in that a structure vulnerable to low temperature toughness, such as upper bainite, is formed due to an increase in hardenability due to grain growth, and thus hydrogen-induced cracking characteristics are deteriorated. On the other hand, if the temperature is lower than Ar3+50° C., the temperature at which the subsequent cooling is started is too low, and thus, the fraction of air-cooled ferrite is excessive and the strength may decrease.

If the cumulative reduction ratio during finish hot rolling in the above-described temperature range is less than 50%, recrystallization by rolling does not occur to the center portion of the steel material, resulting in coarsening of crystal grains in the central portion and deterioration of low temperature toughness.

Cooling

The hot-rolled plate manufactured according to the above may be cooled, and in detail, in the present disclosure, there is technical significance in proposing an optimal cooling process capable of obtaining a steel material having a significantly reduced difference in hardness between the surface layer portion and the central portion.

In detail, the cooling includes primary cooling and secondary cooling, and respective process conditions will be described in detail below. In this case, the primary cooling and the secondary cooling may be performed by applying a specific cooling means, and water cooling may be applied as an example.

Primary Cooling

In the present disclosure, the primary cooling may be performed immediately after finishing the above-described finish hot rolling, and in detail, may preferably start when the temperature of the surface portion of the hot-rolled plate obtained by the finish hot rolling is Ar3−20° C. to Ar3+50° C.

If the starting temperature of the primary cooling exceeds Ar3+50° C., the phase transformation to ferrite on the surface portion may not be sufficiently performed during the primary cooling, and thus, the effect of reducing the hardness of the surface portion may not be obtained. On the other hand, if the temperature is less than Ar3−20° C., excessive ferrite transformation occurs to the central portion, which causes the strength of the steel to decrease.

In addition, the primary cooling may be preferably performed at a cooling rate of 5 to 40° C./s so that the surface temperature of the hot-rolled plate is Ar1−150° C. to Ar1−50° C.

For example, if the end temperature of the primary cooling exceeds Ar1−50° C., the fraction of phase transformation into ferrite on the surface portion of the primary cooled steel material is low, and thus, the effect of reducing the hardness of the surface portion may not be effectively obtained. On the other hand, if the temperature is lower than Ar1−150° C., the ferrite phase transformation occurs excessively to the central portion, and thus, it may be difficult to secure the target level of strength.

In addition, if the cooling rate at the time of the primary cooling is too slow, such as less than 5° C./s, it is difficult to secure the above-described primary cooling end temperature. On the other hand, if it exceeds 40° C./s, the fraction of transformation into the harder phase, for example, the acicular ferrite phase than that of ferrite increases on the surface portion, and thus, it is difficult to secure a soft phase on the surface portion, compared to the central portion.

On the other hand, after completion of the primary cooling, it may be preferable that the temperature of the central portion of the hot-rolled plate is controlled to be Ar3−50° C. to Ar3+10° C.

If the temperature of the central portion exceeds Ar3+10° C. after the primary cooling is completed, the primary cooling end temperature of the surface portion is increased, and the ferrite phase transformation fraction of the surface portion is lowered. On the other hand, if the temperature of the central portion is less than Ar3−50° C., the central portion is excessively cooled, so that the tempering effect of the surface portion due to the central portion having a relatively high temperature may not be obtained, which lowers the effect of reducing the hardness of the surface portion.

Secondary Cooling

It may be preferable to perform secondary cooling immediately after completion of the above-described primary cooling, and the secondary cooling may be preferably performed at a cooling rate of 50 to 500° C./s so that the temperature of the surface portion is 300 to 600° C.

For example, if the end temperature of the secondary cooling is less than 300° C., the fraction of the MA phase increases in the central portion, which adversely affects the securing of low temperature toughness and suppression of hydrogen embrittlement. On the other hand, if the temperature exceeds 600° C., the phase transformation in the central portion may not be completed and it may be difficult to secure strength.

In addition, if the cooling rate is less than 50° C./s during the secondary cooling in the above-described temperature range, crystal grains in the central portion become coarse, and thus, it may be difficult to secure the target level of strength. On the other hand, if the cooling rate exceeds 500° C./s, the fraction of the phase that is vulnerable to low-temperature toughness, as a microstructure of the central portion, such as upper bainite, increases, which deteriorates the resistance to hydrogen-induced cracking and thus is not preferable.

As another example, the steel material according to an exemplary embodiment of the present disclosure may be manufactured through the process of [slab heating—rough rolling—cooling and recalescence—hot rolling—cooling].

Slab Heating

After preparing a steel slab that satisfies the alloy composition and component relationship proposed in the present disclosure, the steel slab may be heated, and at this time, the heating may be carried out at 1100 to 1300° C.

If the heating temperature exceeds 1300° C., not only the scale defects increase, but also the austenite grains become coarse, and thus, there is a concern that the hardenability of the steel may increase. In addition, there is a problem in that resistance to hydrogen-induced cracking is deteriorated by increasing the fraction of the structure vulnerable to low-temperature toughness, such as upper bainite in the central portion. On the other hand, if the temperature is less than 1100° C., there is a concern that the re-solid solution rate of the alloying element is lowered.

Therefore, in the present disclosure, the steel slab may be heated at a temperature ranging from 1100 to 1300° C., and in terms of securing strength and resistance to hydrogen-induced cracking, may be heated at a temperature ranging from 1150 to 1250° C.

Cooling and Recalescence of Rough Rolled Bar

It may be preferable that the heated steel slab according to the above is roughly rolled under normal conditions to produce a bar, and then the bar undergoes a process of cooling and recalescence.

In the present disclosure, before the bar is finishing hot-rolled to be produced as a hot-rolled plate, the austenite grains on the surface portion of the steel may be refined by cooling and recalescence the bar to a specific temperature. Therefore, the hardenability of the surface portion of the steel may be effectively lowered during final cooling (referred to as the cooling process after hot rolling), and the effect of significantly reducing the hardness of the surface portion of the final steel material may be obtained.

In detail, to refine the austenite grains on the surface portion of the steel through the cooling and recalescence, it is necessary to cool only the surface portion under conditions capable of selectively generating transformation-reverse transformation, and preferably, cooling may be performed at least once or more regardless of the cooling means, until the temperature of the surface portion becomes Ar3 or less. In more detail, the cooling may be performed up to a temperature range in which the surface portion is transformed into ferrite.

As mentioned above, the cooling means is not particularly limited, but water cooling may be performed as an example, by using the cooling means.

As described above, after cooling the surface portion to Ar3 or less, recalescence occurs in the surface portion by the central portion having a relatively high temperature. At this time, the temperature range is not particularly limited as long as the recalescence is a temperature range in which the ferrite transformed by cooling is reversely transformed into a single austenite phase.

Finish Hot Rolling

According to the above, the cooled and recalesced bar may be finish hot-rolled to produce a hot-rolled plate, and at this time, finish hot-rolling may be performed with a cumulative reduction ratio of 50% or more in the temperature range of Ar3+50° C. to Ar3+250° C.

If the temperature during the finish hot rolling is higher than Ar3+250° C., there is a problem in that a structure vulnerable to low temperature toughness such as upper bainite is formed due to an increase in hardenability due to grain growth, and thus hydrogen-induced cracking characteristics are deteriorated. On the other hand, if the temperature is lower than Ar3+50° C., the temperature at which the subsequent cooling is started becomes too low, so that the fraction of air-cooled ferrite becomes excessive and the strength may decrease.

If the cumulative reduction ratio during finish hot rolling in the above-described temperature range is less than 50%, recrystallization by rolling does not occur to the center portion of the steel material, resulting in coarsening of crystal grains in the central portion and deterioration of low temperature toughness.

Cooling

The hot-rolled plate manufactured according to the above may be cooled, and the cooling may preferably start when the average temperature of the hot-rolled plate in the thickness direction or the temperature at the point t/4 in the thickness direction is Ar3−50° C. to Ar3+50° C.

If the starting temperature during cooling exceeds Ar3+50° C., the phase transformation into ferrite on the surface portion may not be sufficiently performed during cooling, and thus, the effect of reducing the hardness of the surface portion may not be obtained. On the other hand, if the temperature is less than Ar3−50° C., excessive ferrite transformation occurs to the central portion, which causes the strength of the steel to decrease.

In addition, the cooling may be preferably performed at a cooling rate of 20 to 100° C./s so as to be 300 to 650° C.

The temperature at which the cooling is terminated may be based on the average temperature in the thickness direction or the temperature at the point t/4 in the thickness direction, and if the temperature is less than 300° C., the fraction of the MA phase increases in the central portion, which adversely affects securing of low-temperature toughness and suppression of hydrogen embrittlement. On the other hand, if the temperature exceeds 650° C., the phase transformation in the central portion is completed, and thus, it may be difficult to secure strength.

In addition, if the cooling rate is less than 20° C./s during cooling to the above-described temperature range, crystal grains become coarse, and thus, it may be difficult to secure the strength of the target level. On the other hand, if it exceeds 100° C./s, the fraction of the phase that is vulnerable to low temperature toughness, as a microstructure, such as upper bainite, is increased, which deteriorates the resistance to hydrogen-induced cracking and thus is not preferable.

The steel material according to an exemplary embodiment of the present disclosure manufactured through the series of processes described above may have a thickness of 5 to 50 mm. As described above, the steel material according to an exemplary embodiment has excellent resistance to hydrogen-induced cracking and excellent resistance to sulfide stress corrosion cracking by controlling the difference in hardness between the surface layer portion and the central portion (surface layer portion hardness−center portion hardness) to be 20 Hv or less despite a relatively great thickness of the steel.

Hereinafter, the present disclosure will be described in more detail through examples. However, it should be noted that the following examples are for illustrative purposes only and are not intended to limit the scope of the present disclosure. This is because the scope of the present disclosure is determined by matters described in the claims and matters reasonably inferred therefrom.

MODE FOR INVENTION

Example 1

A steel slab having the alloy composition of Table 1 was prepared. In this case, the content of the alloy composition is % by weight, and the remainders are Fe and unavoidable impurities. The prepared steel slabs were heated, hot-rolled, and cooled under the conditions illustrated in Table 2 below to prepare respective steels.

TABLE 1

| | Alloy Composition (wt %) | | | | | | | | | | | | | | Relation | Ar3 | Ar1 |
|---|---|---|---|---|---|---|---|---|---|---|---|---|---|---|---|---|---|
| Steel Grade | C | Si | Mn | P* | S* | Al | N* | Ni | Cr | Mo | Nb | Ti | V | Ca* | 1 | (° C.) | (° C.) |
| Inventive Steel 1 | 0.04 | 0.24 | 1.09 | 60 | 7 | 0.024 | 30 | 0.21 | 0.18 | 0.08 | 0.043 | 0.012 | 0.02 | 18 | 2.6 | 798 | 722 |
| Inventive Steel 2 | 0.038 | 0.25 | 1.25 | 60 | 9 | 0.023 | 40 | 0.14 | 0.12 | 0.06 | 0.041 | 0.013 | 0 | 16 | 1.8 | 788 | 723 |
| Inventive Steel 3 | 0.042 | 0.23 | 1.22 | 90 | 8 | 0.025 | 40 | 0.15 | 0.16 | 0.07 | 0.046 | 0.011 | 0 | 11 | 1.4 | 789 | 723 |
| Comparative Steel 1 | 0.11 | 0.25 | 1.44 | 80 | 8 | 0.031 | 50 | 0.21 | 0.12 | 0.06 | 0.050 | 0.011 | 0.02 | 15 | 1.9 | 751 | 716 |
| Comparative Steel 2 | 0.036 | 0.24 | 2.11 | 80 | 8 | 0.029 | 60 | 0 | 0.1 | 0 | 0.035 | 0.012 | 0.02 | 11 | 1.4 | 737 | 717 |
| Comparative Steel 3 | 0.037 | 0.22 | 1.22 | 60 | 10 | 0.038 | 40 | 0.16 | 0.19 | 0 | 0.044 | 0.013 | 0 | 4 | 0.4 | 797 | 722 |
| Comparative Steel 4 | 0.04 | 0.24 | 1.09 | 60 | 7 | 0.024 | 30 | 0.21 | 0.18 | 0.08 | 0.043 | 0.012 | 0.02 | 18 | 2.6 | 798 | 722 |

(P*, S*, N*, and Ca* in Table 1 are expressed in ppm.

In addition, it is calculated by Ar3=910−310×C−80×Mn−20×Cu−15×Cr−55×Ni−80×Mo+0.35×(thickness (mm)−8), Ar1=742−7.1×C−14.1×Mn+16.3×Si+11.5×Cr−49.7×Ni.)

TABLE 2

| | | | | Finish Rolling | | Presence or absence of | Primary Cooling |
|---|---|---|---|---|---|---|---|
| Steel Grade | Classification | Thickness (mm) | Heating Temperature (° C.) | Temperature (° C.) | Reduction Ratio (%) | second-stage cooling | Starting Temperature (° C.) |
| Inventive Steel 1 | Inventive Example 1 | 30.9 | 1128 | 893 | 80 | ○ | 825 |
| Inventive Steel 2 | Inventive Example 2 | 19.5 | 1158 | 918 | 77 | ○ | 815 |
| Inventive Steel 3 | Inventive Example 3 | 25.7 | 1145 | 905 | 77 | ○ | 822 |
| Comparative Steel 1 | Comparative Example 1 | 30.9 | 1129 | 850 | 75 | x | 803 |
| Comparative Steel 2 | Comparative Example 2 | 30.9 | 1127 | 848 | 75 | x | 780 |
| Comparative Steel 3 | Comparative Example 3 | 30.9 | 1133 | 895 | 77 | x | 823 |
| Comparative Steel 4 | Comparative Example 4 | 30.9 | 1131 | 888 | 80 | x | 823 |
| | Comparative Example 5 | 30.9 | 1132 | 895 | 77 | ○ | 825 |
| | Comparative Example 6 | 30.9 | 1145 | 879 | 75 | ○ | 830 |

TABLE 2-continued

| Steel Grade | Classification | Primary Cooling: Cooling Rate (° C./s) | Primary Cooling: Surface Portion End Temperature (° C.) | Primary Cooling: Central Portion End Temperature (° C.) | Surface temperature after air cooling (° C.) | Secondary Cooling: Surface Portion End Temperature (° C.) | Secondary Cooling: Cooling Rate (° C./s) |
|---|---|---|---|---|---|---|---|
| Inventive Steel 1 | Inventive Example 1 | 22 | 710 | 802 | 772 | 466 | 345 |
| Inventive Steel 2 | Inventive Example 2 | 13 | 699 | 799 | 754 | 489 | 321 |
| Inventive Steel 3 | Inventive Example 3 | 17 | 703 | 799 | 765 | 443 | 245 |
| Comparative Steel 1 | Comparative Example 1 | 245 | 492 | 495 | — | — | — |
| Comparative Steel 2 | Comparative Example 2 | 255 | 488 | 494 | — | — | — |
| Comparative Steel 3 | Comparative Example 3 | 261 | 503 | 495 | — | — | — |
| Comparative Steel 4 | Comparative Example 4 | 359 | 465 | 483 | — | — | — |
| | Comparative Example 5 | 25 | 611 | 754 | 642 | 455 | 324 |
| | Comparative Example 6 | 123 | 724 | 789 | 777 | 454 | 333 |

Yield strength (YS), Vickers hardness at the surface portion and the central portion, and resistance to sulfide stress cracking were measured for the respective steels manufactured according to the above, and the microstructure was observed, and the results are illustrated in Table 3 below.

In this case, the yield strength refers to 0.5% under-load yield strength, and the tensile specimen was tested after taking the API-5L standard test piece in a direction perpendicular to the rolling direction.

The hardness of each steel material per location was measured with a load of 1 kgf, using a Vickers hardness tester. In this case, the hardness at the central portion was measured at the t/2 position after cutting the steel material in the thickness direction, and the hardness at the surface portion was measured at the surface of the steel material.

The microstructure was measured using an optical microscope, and the type of phase was observed using an image analyzer.

In addition, for the resistance to sulfide stress cracking, after applying an applied stress of 90% yield strength to the specimen in a standard solution of strong acid (5% NaCl+0.5% acetic acid) saturated with 1 bar of $H_2S$ gas according to NACE TM0177 regulations, the presence or absence of the fracture was observed within 720 hours.

TABLE 3

| Classification | Microstructure: Surface Portion | Microstructure: Central Portion | Hardness (Hv): Surface Portion | Hardness (Hv): Central Portion | Hardness (Hv): Hardness Difference | Yield Strength (MPa) | SSC |
|---|---|---|---|---|---|---|---|
| Inventive Example 1 | F + P | AF | 173 | 186 | −13 | 464 | Not occurred |
| Inventive Example 2 | F + P | AF | 181 | 196 | −15 | 489 | Not occurred |
| Inventive Example 3 | F + P | AF | 177 | 191 | −14 | 481 | Not occurred |
| Comparative Example 1 | UB | AF + UB | 284 | 235 | 49 | 534 | Occurred |
| Comparative Example 2 | UB | AF + UB | 275 | 244 | 31 | 545 | Occurred |
| Comparative Example 3 | AF | AF | 224 | 194 | 30 | 483 | Occurred |
| Comparative Example 4 | AF | AF | 228 | 191 | 37 | 478 | Not occurred |
| Comparative Example 5 | F + P | AF + F + P | 175 | 181 | −6 | 421 | Not occurred |
| Comparative Example 6 | AF | AF | 224 | 198 | 26 | 475 | Not occurred |

(In Table 3, F denotes ferrite, P denotes pearlite, AF denotes acicular ferrite, and UP denotes upper bainite.)

As illustrated in Tables 1 to 3, in Inventive Examples 1 to 3, which satisfy all of the alloy composition and manufacturing conditions proposed in the present disclosure, it can be confirmed that the hardness of the surface portion is significantly low, compared to that of the central portion, and resistance to sulfide stress cracking may also be excellent (see FIG. 1).

Meanwhile, in Comparative Examples 1 to 3, in which the alloy composition proposed in the present disclosure is not satisfied, and the cooling process is also out of the conditions of the present disclosure, and in Comparative Example 4 in which the alloy composition proposed in the present disclosure is satisfied, but the cooling process is outside of the present disclosure, the hardness of the surface portion was excessively higher than that of the central portion, and the difference was 30 Hv or more. Furthermore, SSC characteristics were also inferior in Comparative Examples 1 to 3.

In Comparative Examples 5 and 6, although multi-stage cooling was applied as in the present disclosure, in Comparative Example 5, ferrite and pearlite were formed in the central portion due to the excessively low end temperature of the surface portion during the primary cooling, and thus, the yield strength was less than 450 MPa, and thus, it was difficult to secure the intended strength. In Comparative Example 6, the cooling rate was excessively fast during the primary cooling, so that a soft phase was not formed in a base structure of the surface portion, compared to in the central portion, and thus, the hardness of the surface portion was higher exceeding 20 Hv than that of the central portion.

Example 2

A steel slab having the alloy composition of Table 4 below was prepared. In this case, the content of the alloy composition is % by weight, and the remainders are Fe and unavoidable impurities. The prepared steel slabs were heated, hot-rolled, and cooled under the conditions illustrated in Table 5 below to prepare respective steels.

TABLE 4

| | Alloy Composition (wt %) | | | | | | | | | | | | | | Relation | Ar3 | Ar1 |
|---|---|---|---|---|---|---|---|---|---|---|---|---|---|---|---|---|---|
| Steel Grade | C | Si | Mn | P* | S* | Al | N* | Ni | Cr | Mo | Nb | Ti | V | Ca* | 1 | (° C.) | (° C.) |
| Inventive Steel 1 | 0.04 | 0.24 | 1.09 | 60 | 7 | 0.024 | 30 | 0.21 | 0.18 | 0.08 | 0.043 | 0.012 | 0.02 | 18 | 2.6 | 798 | 722 |
| Inventive Steel 2 | 0.038 | 0.25 | 1.25 | 60 | 9 | 0.023 | 40 | 0.14 | 0.12 | 0.06 | 0.041 | 0.013 | 0 | 16 | 1.8 | 788 | 723 |
| Inventive Steel 3 | 0.042 | 0.23 | 1.22 | 90 | 8 | 0.025 | 40 | 0.15 | 0.16 | 0.07 | 0.046 | 0.011 | 0 | 11 | 1.4 | 789 | 723 |
| Comparative Steel 1 | 0.11 | 0.25 | 1.44 | 80 | 8 | 0.031 | 50 | 0.21 | 0.12 | 0.06 | 0.05 | 0.011 | 0.02 | 15 | 1.9 | 751 | 716 |
| Comparative Steel 2 | 0.036 | 0.24 | 2.11 | 80 | 8 | 0.029 | 60 | 0 | 0.1 | 0 | 0.035 | 0.012 | 0.02 | 11 | 1.4 | 737 | 717 |
| Comparative Steel 3 | 0.037 | 0.22 | 1.22 | 60 | 10 | 0.038 | 40 | 0.16 | 0.19 | 0 | 0.044 | 0.013 | 0 | 4 | 0.4 | 797 | 722 |
| Comparative Steel 4 | 0.04 | 0.24 | 1.09 | 60 | 7 | 0.024 | 30 | 0.21 | 0.18 | 0.08 | 0.043 | 0.012 | 0.02 | 18 | 2.6 | 798 | 722 |

(P*, S*, N*, and Ca* in Table 4 are expressed in ppm.

In addition, it is calculated by [Ar3=910−310×C−80×Mn−20×Cu−15×Cr−55×Ni−80×Mo+0.35×(thickness (mm)−8)], and [Ar1=742−7.1×C−14.1×Mn+16.3×Si+11.5×Cr−49.7×Ni].)

TABLE 5

| | | | | Finish Rolling | | Presence or absence | Primary Cooling | | | | Secondary Cooling | |
|---|---|---|---|---|---|---|---|---|---|---|---|---|
| | | | | | | | | | Surface Portion | Central Portion | Surface Portion | |
| Steel Grade | Classification | Thickness (mm) | Heating Temperature (° C.) | Temperature (° C.) | Reduction Ratio (%) | of second-stage cooling | Starting Temperature (° C.) | Cooling Rate (° C./s) | End Temperature (° C.) | End Temperature (° C.) | End Temperature (° C.) | Cooling Rate (° C./s) |
| Inventive Steel 1 | Inventive Example 1 | 30.9 | 1139 | 888 | 77 | ○ | 820 | 18 | 584 | 795 | 471 | 288 |
| Inventive Steel 2 | Inventive Example 2 | 19.5 | 1148 | 920 | 75 | ○ | 811 | 14 | 595 | 780 | 448 | 274 |
| Inventive Steel 3 | Inventive Example 3 | 25.7 | 1142 | 911 | 77 | ○ | 818 | 16 | 587 | 788 | 452 | 249 |
| Comparative Steel 1 | Comparative Example 1 | 30.9 | 1142 | 845 | 75 | x | 789 | 245 | 456 | 495 | — | — |
| Comparative Steel 2 | Comparative Example 2 | 30.9 | 1138 | 822 | 75 | x | 765 | 255 | 489 | 494 | — | — |
| Comparative Steel 3 | Comparative Example 3 | 30.9 | 1121 | 899 | 77 | x | 822 | 261 | 499 | 495 | — | — |
| Comparative Steel 4 | Comparative Example 4 | 30.9 | 1148 | 892 | 77 | x | 823 | 281 | 465 | 483 | — | — |
| | Comparative Example 5 | 30.9 | 1125 | 867 | 77 | ○ | 821 | 25 | 711 | 780 | 467 | 281 |
| | Comparative Example 6 | 30.9 | 1129 | 879 | 75 | ○ | 826 | 77 | 494 | 689 | 475 | 276 |

Yield strength (YS), Vickers hardness at the surface and central portions, and resistance to sulfide stress cracking were measured for the respective steel materials manufactured according to the above, and the microstructure was observed, and the results are illustrated in Table 6 below.

In this case, the yield strength refers to 0.5% under-load yield strength, and the tensile specimen was tested after taking the API-5L standard test piece in a direction perpendicular to the rolling direction.

The hardness of the steel material per location was measured with a load of 1 kgf using a Vickers hardness tester. In this case, the hardness of the central portion was measured at the t/2 position after cutting the steel material in the thickness direction, and the hardness of the surface portion was measured at the surface of the steel material.

The microstructure was measured using an optical microscope, and the type of phase was observed using an image analyzer.

In addition, for the resistance to sulfide stress cracking, after applying an applied stress of 90% yield strength to the specimen in a standard solution of strong acid (5% NaCl+0.5% acetic acid) saturated with 1 bar of $H_2S$ gas according to NACE TM0177 regulations, the presence or absence of the fracture was observed within 720 hours.

TABLE 6

| | Microstructure | | Hardness (Hv) | | | Yield | |
|---|---|---|---|---|---|---|---|
| Classification | Surface Portion | Central Portion | Surface Portion | Central Portion | Hardness Difference | Strength (MPa) | SSC |
| Inventive Example 1 | F + P | AF | 178 | 186 | −8 | 477 | Not occurred |
| Inventive Example 2 | F + P | AF | 182 | 192 | −10 | 480 | Not occurred |
| Inventive Example 3 | F + P | AF | 176 | 190 | −14 | 468 | Not occurred |
| Comparative Example 1 | UB | AF + UB | 284 | 255 | 29 | 544 | Occurred |
| Comparative Example 2 | UB | AF + UB | 280 | 245 | 35 | 555 | Occurred |
| Comparative Example 3 | AF | AF | 216 | 192 | 24 | 483 | Occurred |
| Comparative Example 4 | AF | AF | 222 | 194 | 28 | 486 | Not occurred |
| Comparative Example 5 | AF + F | AF | 212 | 191 | 21 | 479 | Not occurred |
| Comparative Example 6 | F + P + AF | AF + F + P | 172 | 178 | −6 | 421 | Not occurred |

(In Table 6, F denotes ferrite, P denotes pearlite, AF denotes acicular ferrite, and UP denotes upper bainite.)

As illustrated in Tables 4 to 6, in Inventive Examples 1 to 3, which satisfy all of the alloy composition and manufacturing conditions proposed in the present disclosure, it can be confirmed that the hardness of the surface portion is low compared to that of the central portion, and resistance to sulfide stress cracking is also excellent (see FIG. 2).

On the other hand, in Comparative Examples 1 to 3 in which the alloy composition proposed in the present disclosure is not satisfied, and the cooling process is also out of the conditions of the present disclosure, and in Comparative Example 4 in which the alloy composition proposed in the present disclosure is satisfied, but the cooling process is out of the present disclosure, the hardness of the surface portion was excessively higher than that of the central portion, and the difference exceeded 20 Hv. SSC characteristics were also inferior in Comparative Examples 1 to 3.

In Comparative Examples 5 and 6, although multi-stage cooling was applied as in the present disclosure, in Comparative Example 5, the end temperature of the surface portion was excessively high during the primary cooling, so that the ferrite phase, which is a soft phase, was not sufficiently formed on the surface portion, compared to the central portion. Therefore, the hardness of the surface portion was higher than that of the central portion. In Comparative Example 6, the cooling rate during the primary cooling was excessive, and the end temperature of the surface portion was excessively low, and the end temperature of the central portion was also low. Accordingly, it was difficult to secure the intended strength in which ferrite and pearlite are formed in the central portion to have a yield strength of less than 450 MPa.

Example 3

A steel slab having the alloy composition of Table 7 below was prepared. In this case, the content of the alloy composition is % by weight, and the remainders are Fe and unavoidable impurities. The prepared steel slabs were heated, hot-rolled, and cooled under the conditions illustrated in Table 8 below to prepare respective steels. In this case, rough rolling was performed on the steel slab in which the heating has been completed, under normal conditions, to produce a bar, and then, hot rolling was performed after cooling the bar for some steel types. The hot-rolling was performed after the cooled bar was recalesced to the austenite single-phase region.

TABLE 7

| Steel Grade | Alloy Composition (wt %) | | | | | | | | | | | | | | Relation | Ar3 | Ar1 |
|---|---|---|---|---|---|---|---|---|---|---|---|---|---|---|---|---|---|
| | C | Si | Mn | P* | S* | Al | N* | Ni | Cr | Mo | Nb | Ti | V | Ca* | 1 | (° C.) | (° C.) |
| Inventive Steel 1 | 0.04 | 0.24 | 1.09 | 60 | 7 | 0.024 | 30 | 0.21 | 0.18 | 0.08 | 0.043 | 0.012 | 0.02 | 18 | 2.6 | 798 | 722 |
| Inventive Steel 2 | 0.038 | 0.25 | 1.25 | 60 | 9 | 0.023 | 40 | 0.14 | 0.12 | 0.06 | 0.041 | 0.013 | 0 | 16 | 1.8 | 788 | 723 |
| Comparative Steel 1 | 0.11 | 0.25 | 1.44 | 80 | 8 | 0.031 | 50 | 0.21 | 0.12 | 0.06 | 0.05 | 0.011 | 0.02 | 15 | 1.9 | 751 | 716 |
| Comparative Steel 2 | 0.036 | 0.24 | 2.11 | 80 | 8 | 0.029 | 60 | 0 | 0.1 | 0 | 0.035 | 0.012 | 0.02 | 11 | 1.4 | 737 | 717 |
| Comparative Steel 3 | 0.037 | 0.22 | 1.22 | 60 | 10 | 0.038 | 40 | 0.16 | 0.19 | 0 | 0.044 | 0.013 | 0 | 4 | 0.4 | 797 | 722 |
| Comparative Steel 4 | 0.04 | 0.24 | 1.09 | 60 | 7 | 0.024 | 30 | 0.21 | 0.18 | 0.08 | 0.043 | 0.012 | 0.02 | 18 | 2.6 | 798 | 722 |

(P*, S*, N*, and Ca* in Table 7 are expressed in ppm.

In addition, it is calculated by [Ar3=910−310×C−80×Mn−20×Cu−15×Cr−55×Ni−80×Mo+0.35×(thickness (mm)−8)], and [Ar1=742−7.1×C−14.1×Mn+16.3×Si+11.5×Cr−49.7×Ni].)

TABLE 8

| Steel Grade | Classification | Thickness (mm) | Heating Temperature (° C.) | Bar Cooling Number of water cooling | Bar Cooling End Temperature (° C.) | Finish Hot Rolling Temperature (° C.) | Finish Hot Rolling Reduction Ratio (%) | Cooling Starting Temperature (° C.) | Cooling End Temperature (° C.) | Cooling Rate (° C./s) |
|---|---|---|---|---|---|---|---|---|---|---|
| Inventive Steel 1 | Inventive Example 1 | 30.9 | 1128 | 2 | 755 | 888 | 75 | 822 | 471 | 26 |
| Inventive Steel 2 | Inventive Example 2 | 19.5 | 1129 | 2 | 742 | 920 | 75 | 824 | 448 | 42 |
| Comparative Steel 1 | Comparative Example 1 | 30.9 | 1134 | 0 | — | 845 | 75 | 785 | 456 | 24 |
| Comparative Steel 2 | Comparative Example 2 | 30.9 | 1138 | 0 | — | 822 | 75 | 770 | 442 | 30 |
| Comparative Steel 3 | Comparative Example 3 | 30.9 | 1124 | 2 | 744 | 899 | 75 | 826 | 486 | 26 |
| Comparative Steel 4 | Comparative Example 4 | 30.9 | 1136 | 0 | — | 892 | 75 | 829 | 477 | 24 |
| | Comparative Example 5 | 30.9 | 1129 | 0 | — | 879 | 75 | 822 | 475 | 28 |

Yield strength (YS), Vickers hardness at the surface and central portions, and resistance to sulfide stress cracking were measured for the respective steel materials manufactured according to the above, and the microstructure was observed, and the results are illustrated in Table 9 below.

In this case, the yield strength refers to 0.5% under-load yield strength, and the tensile specimen was tested after taking the API-5L standard test piece in a direction perpendicular to the rolling direction.

The hardness of each steel material per location was measured with a load of 1 kgf using a Vickers hardness tester. In this case, the hardness of the central portion was measured at the t/2 position after cutting the steel material in the thickness direction, and the hardness of the surface portion was measured at the surface of the steel material.

The microstructure was measured using an optical microscope, and the type of phase was observed using an image analyzer.

In addition, for the resistance to sulfide stress cracking, after applying an applied stress of 90% yield strength to the specimen in a standard solution of strong acid (5% NaCl+0.5% acetic acid) saturated with 1 bar of $H_2S$ gas according to NACE TM0177 regulations, the presence or absence of the fracture was observed within 720 hours.

TABLE 9

| Classification | Microstructure Surface Portion | Microstructure Central Portion | Hardness (Hv) Surface Portion | Hardness (Hv) Central Portion | Hardness (Hv) Hardness Difference | Yield Strength (MPa) | SSC |
|---|---|---|---|---|---|---|---|
| Inventive Example 1 | F + P | AF | 188 | 192 | −4 | 488 | Not occurred |

TABLE 9-continued

| Classification | Microstructure | | Hardness (Hv) | | | Yield | |
|---|---|---|---|---|---|---|---|
| | Surface Portion | Central Portion | Surface Portion | Central Portion | Hardness Difference | Strength (MPa) | SSC |
| Inventive Example 2 | F + P | AF | 186 | 194 | −8 | 478 | Not occurred |
| Comparative Example 1 | UB | AF + UB | 289 | 256 | 33 | 544 | Occurred |
| Comparative Example 2 | UB | AF + UB | 286 | 254 | 32 | 549 | Occurred |
| Comparative Example 3 | F + P | AF | 188 | 193 | −5 | 477 | Occurred |
| Comparative Example 4 | AF | AF | 221 | 195 | 26 | 493 | Not occurred |
| Comparative Example 5 | AF | AF | 219 | 192 | 27 | 491 | Not occurred |

(In Table 9, F denotes ferrite, P denotes pearlite, AF denotes acicular ferrite, and UP denotes Upper Bainite.)

As illustrated in Tables 7 to 9, in Inventive Examples 1 and 2 satisfying all of the alloy composition and manufacturing conditions proposed in the present disclosure, it can be confirmed that the hardness of the surface portion is significantly lower than that of the central portion, and resistance to sulfide stress cracking is also excellent (see FIG. 3).

Meanwhile, in Comparative Examples 1 and 2, which did not satisfy the alloy composition proposed in the present disclosure, and the manufacturing process was also out of the conditions of the present disclosure, the hardness of the surface portion was excessively higher than that of the central portion, and the difference exceeded 30 Hv, and the SSC characteristic was also inferior.

In Comparative Example 3, the effect of reducing the hardness of the surface portion may be obtained as the steel material was prepared by the manufacturing process proposed in the present disclosure, but the SSC characteristics were inferior as the content of Ca and the component ratio of Ca/S in the alloy composition deviated from the present disclosure.

In Comparative Examples 4 and 5, the alloy composition satisfies the scope of the present disclosure, but it is the case in which the manufacturing process, in detail, cooling process of the rough-rolled bar was not performed, and the hardness of the surface portion was excessively higher than that of the central portion, and the difference exceeded 20 Hv.

The invention claimed is:

1. A high-strength steel material having excellent resistance to sulfide stress cracking, comprising:

in % by weight, carbon (C): 0.02 to 0.06%, silicon (Si): 0.1 to 0.5%, manganese (Mn): 0.8 to 1.8%, phosphorus (P): 0.03% or less, sulfur (S): 0.003% or less, aluminum (Al): 0.06% or less, nitrogen (N): 0.01% or less, niobium (Nb): 0.005 to 0.08%, titanium (Ti): 0.005 to 0.05%, and calcium (Ca): 0.0005 to 0.005%; at least one of nickel (Ni): 0.05 to 0.3%, chromium (Cr): 0.05 to 0.3%, molybdenum (Mo): 0.02 to 0.2% and vanadium (V): 0.005 to 0.1%; and Fe and unavoidable impurities as balances, wherein in the steel material, a microstructure of the surface layer portion is composed of a complex structure of ferrite and pearlite, and a microstructure of the central portion is composed of acicular ferrite, wherein the Ca and S satisfy relational formula 1: $0.5 \leq Ca/S \leq 5.0$, where each element refers to weight content, and a difference between a hardness value of a surface layer portion and a hardness value of a central portion (surface layer portion hardness−center portion hardness) is 20 Hv or less of Vickers hardness.

2. The high-strength steel having excellent resistance to sulfide stress cracking of claim 1, wherein the high-strength steel material has a yield strength of 450 MPa or more.

3. The high-strength steel having excellent resistance to sulfide stress cracking of claim 1, wherein the high-strength steel material has a thickness of 5 to 50 mm.

* * * * *